US005472121A

United States Patent [19]

Silano

[11] Patent Number: 5,472,121

[45] Date of Patent: Dec. 5, 1995

[54] PLASTIC LID WITH POUR SPOUT, VENT AND SNAP ON CAP

[76] Inventor: John R. Silano, 47 Ridge Rd., Roseland, N.J. 07068

[21] Appl. No.: 205,550

[22] Filed: Mar. 4, 1994

[51] Int. Cl.[6] ..... B67D 5/38

[52] U.S. Cl. ..... 222/158; 222/481.5; 222/562; 222/571; 220/254; 220/373

[58] Field of Search ..... 222/109, 158, 222/481, 481.5, 562, 570, 571; 220/206, 254, 373

[56] References Cited

U.S. PATENT DOCUMENTS

| | | | |
|---|---|---|---|
| 576,018 | 1/1897 | Alexander | 222/481 X |
| 2,601,039 | 6/1952 | Livingstone | 222/109 |
| 2,601,040 | 6/1952 | Livingstone | 222/109 |
| 2,763,403 | 9/1956 | Livingstone | 222/570 X |
| 2,986,310 | 5/1961 | Spaulding | 222/481.5 |
| 3,208,650 | 9/1965 | Ham | 222/570 X |
| 4,105,142 | 8/1978 | Morris, Jr. | 222/158 |
| 4,706,829 | 11/1987 | Li | 222/571 X |
| 4,863,067 | 9/1989 | Krall | 222/571 X |
| 4,890,770 | 1/1990 | Haga et al. | 222/109 |
| 4,981,239 | 1/1991 | Cappel et al. | 222/109 |
| 5,058,772 | 10/1991 | Moore et al. | 222/571 X |
| 5,088,614 | 2/1992 | Dumestre | 220/254 X |
| 5,108,009 | 4/1992 | Davidson et al. | 222/571 X |
| 5,251,788 | 10/1993 | Moore | 222/571 X |

FOREIGN PATENT DOCUMENTS

| | | | |
|---|---|---|---|
| 0939283 | 1/1974 | Canada | 222/570 |

*Primary Examiner*—Andres Kashnikow
*Assistant Examiner*—Joseph A. Kaufman
*Attorney, Agent, or Firm*—Aquilino & Welsh

[57] ABSTRACT

A flexible plastic lid including a tubular pour spout with a separate snap on cap and vent is disclosed. The lid includes a pour spout extending from the base and located near the rim to ensure maximum pour efficiency. An air vent is positioned opposite the pour spout and allows liquids to flow freely without clogging the spout. The air vent is operated by pushing and pulling the vent. Once engaged, the lid creates an air tight enclosure for maintaining the freshness of the contents. Additionally, the can is compact in height for cold storage shelf space where space is at a premium in the kitchen. Once the snap on cap is engaged by the lip on the inside of the cap, a leak-proof seal is formed. The can lid is preferably made of molded plastic that is pliable to tightly snap onto the can, yet durable to withstand the heat of commercial dishwashers.

11 Claims, 2 Drawing Sheets

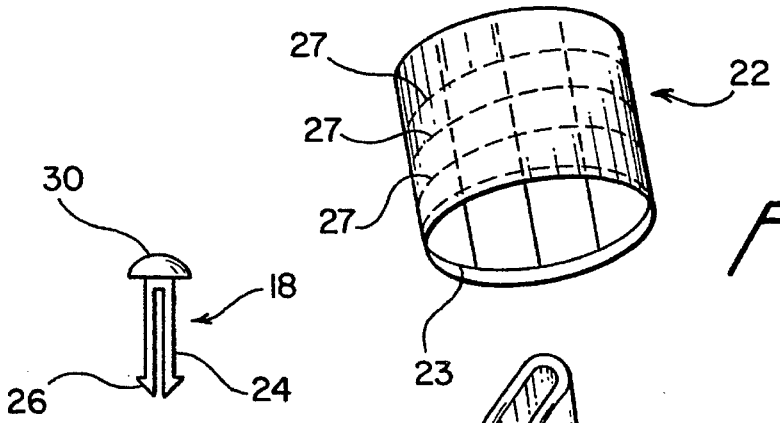
FIG. 1b
FIG. 1a
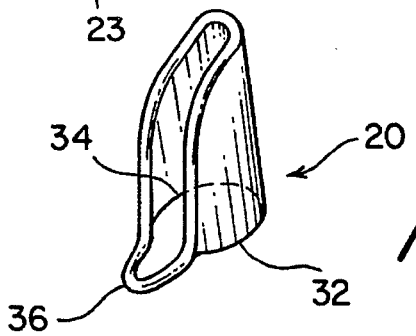
FIG. 1c
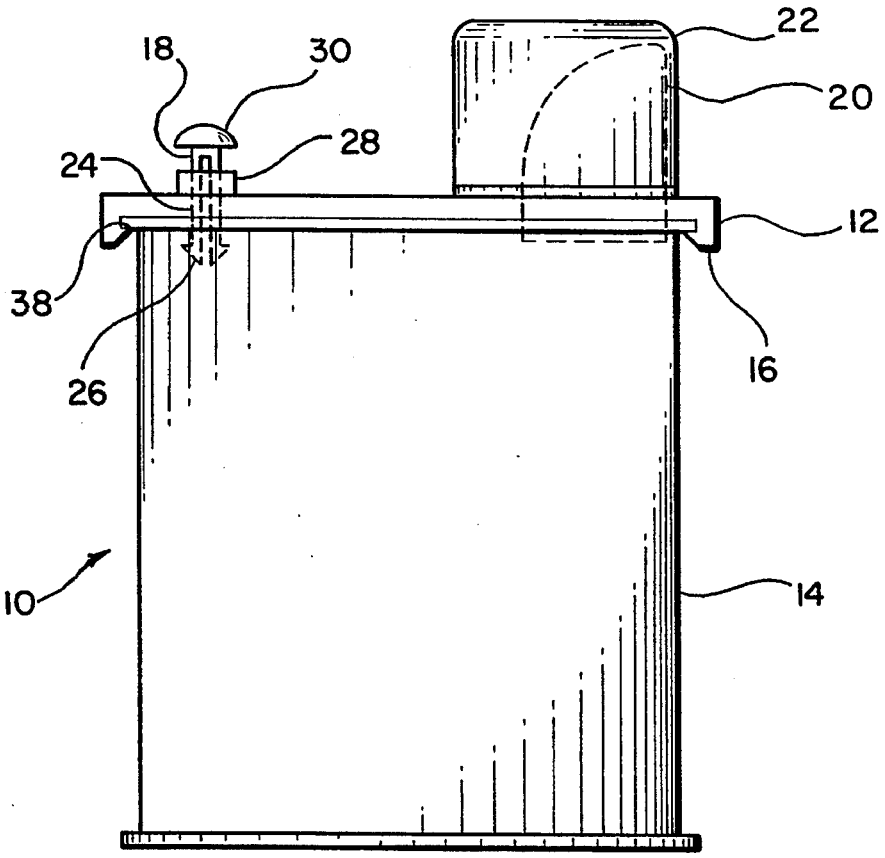
FIG. 1

PLASTIC LID WITH POUR SPOUT, VENT AND SNAP ON CAP

BACKGROUND OF THE INVENTION

1. Field of the Invention

This invention relates to plastic containers. More specifically, the invention relates to a lid including a pour spout and a separate vent for use with cans. A separate snap on cap covers the pour spout. The cap can be used as a measuring cup for use with liquids, powders and sauces.

2. Description of the Prior Art

Consumers are often confronted with messiness when dispensing liquids, powders and sauces from metal cans having wide open tops. Messiness often occurs from drops of the liquid contents. Messiness also results from over pour which drains down the side of the can (especially if a funnel is not used) upon the completion of pouring. Additionally, when a metal lid is removed with a can opener and the wide top is left open, the can could easily topple, spill or become contaminated by foreign debris if the entire contents are not used at once.

Additionally, sometimes only a portion of the contents of the can are used, as in the case of ketchup and tomato sauce. Typically, plastic wrap is used to cover the contents of an opened can. However, this is costly and adds to disposal waste. Alternatively, metal cans are left uncovered in an unhealthy manner.

Therefore, a need exists for a container closure lid to ensure open cans are properly stored. Also, a need exists for a container closure lid facilitating easy dispensing of liquids, sauces and powders without messy spills.

SUMMARY OF THE INVENTION

It is the objective of the present invention to provide a durable, convenient, and versatile lid which is economical to manufacture.

It is another object of the present invention to provide a container lid benefiting the consumer in dispensing liquids, powders and sauces from metal cans, without over pouring or messy spills.

The shortcomings of the prior art are overcome by the present invention which comprises a snap on lid having a pour spout, a push-pull vent and a snap on cap. The lid is conveniently snapped onto a container, can or cup to create an airtight enclosure for maintaining the freshness of the enclosure's contents.

Other objects, advantages and salient features of the invention will become apparent from the following detailed description, which taken in conjunction with the annexed drawings, discloses the preferred embodiment of the present invention.

BRIEF DESCRIPTION OF THE DRAWINGS

FIG. 1 is a side view of the present invention.

FIGS. 1*a*, 1*b* and 1*c* are detailed side views of the push-pull vent, cap and spout, respectively.

DESCRIPTION OF THE PREFERRED EMBODIMENTS

Figure 2A:
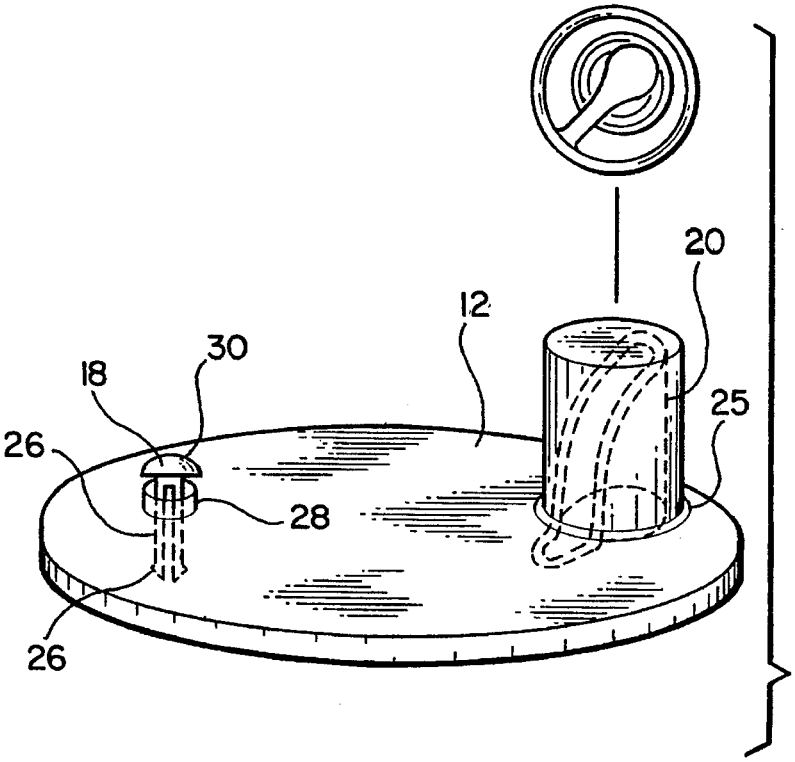
FIG. 2*a* is a top perspective view of the lid.

With reference to FIG. 1, the enclosure 10 includes a lid 12 attached to a metal can 14. The lid 12 is preferably made of pliable plastic and includes a lip 16 permitting the lid 12 to snap onto the can 14. The lid 12 also includes a push-pull vent 18, a pour spout 20 and a snap on cap 22. The cap 22 may act as a measuring device when it is detached from the lid 12.

Figure 2B:
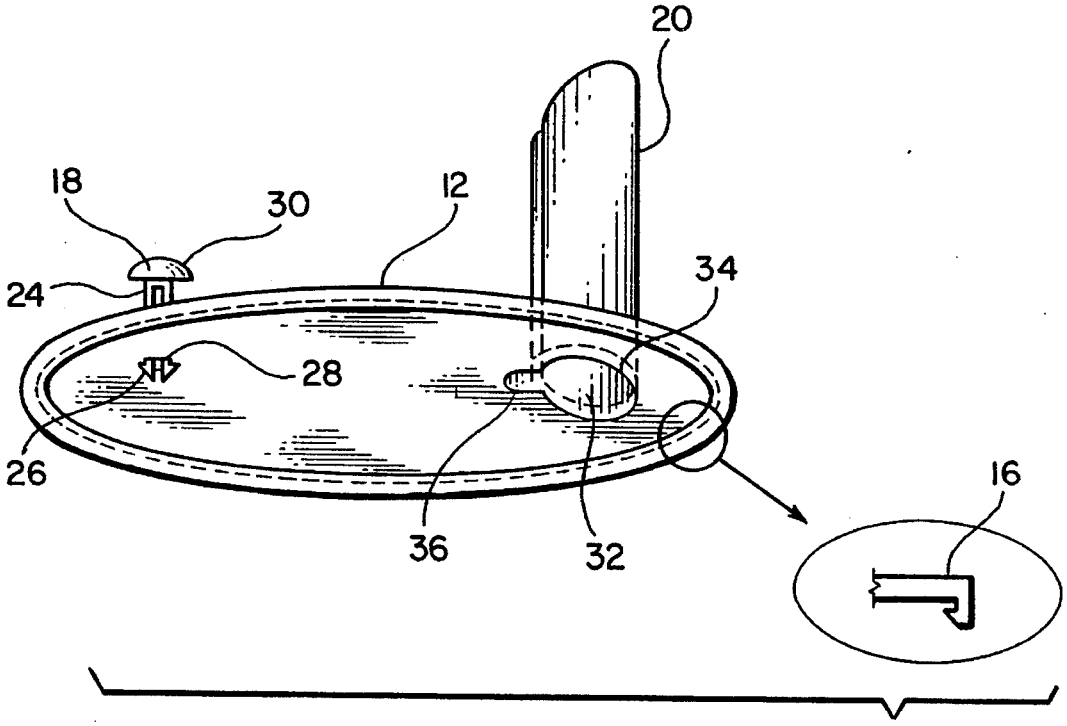
FIG. 2*b* is a bottom perspective view of the lid.

With reference to FIGS. 1*a*, 1*b* and 1*c*, the pour spout 20, push-pull vent 18 and snap on cap 22 are respectively shown. When the lid 12 is fully assembled, the pour spout 20 and the push-pull vent 18 are one with the lid 12. The snap on cap 22 is separable from the lid 12. The cap 22 is secured to the lid 12 by engageable lips on the cap 22 and the lid 12. Specifically, the cap 22 includes an inner lip 23 designed to engage an outer lip 25 surrounding the pour spout 20. The cap 22 provides a safety seal and measuring cup for both liquids and powders. The cap 22 keeps fluids and powders inside the can 14 for airtight freshness. The snap on cap also includes graduated lines 27 for tablespoon measurements.

with reference to FIGS. 2*a* and 2*b*, details of the push-pull vent 18 are disclosed. The vent 18 is attached to the lid 12 by arms 24 having projections 26. Specifically, the lid 12 has an opening 28 in which the vent 18 is positioned. While the top 30 of the vent engages the top surface surrounding the opening 28, the arms 24 pass through the opening and the projections 26 prevent the vent 18 from being removed when the vent 18 is pulled by a user. However, the vent 18 may be removed from the opening 28 to clean the vent 18 and opening 28 after extended use. The vent 18 is removed by applying pressure to the arms 24 and withdrawing the vent 18 from the opening 28.

The pour spout 20 is secured to the lid 12 beneath the lid 12. The pour spout 20 is one with the lid.

The pour spout 20 extends from the base of the snap on lid 12 at a position near the lip 16 of the lid 12. The spout 20 has a funnel-like shape with a keyhole opening 32. The keyhole shape acts to direct the contents of the enclosure 10 out through the rounded position 34, while the straight narrow part 36 of the spout 20 allows air into the enclosure 10. The straight narrow portion 36 also helps direct the flow of thick sauces, such as ketchup and tomato sauce, without clogging.

In use, the lid 12 is snapped onto an appropriately sized can 14 to form an airtight enclosure 10. When the contents of the enclosure 10 are in storage, the cap 22 is positioned over the spout, the vent 18 is in its closed position (that is, it is pushed down so that the top 30 engages the surface surrounding the opening 28), and the lip 16 is sealed about the rim 38 of the can 14. When a consumer wishes to pour the contents from the enclosure 10, the consumer removes the cap 22, inverts the enclosure for pouring and operates the vent 18 to control the flow of the contents from the enclosure 10. Specifically, the consumer pulls or pushes the vent 18 to respectively open or close the enclosure 10 and control the flow of the contents. The lid 12 is preferably manufactured by injection molding plastic to produce a pliable lid 12, able to be snapped onto a can or other container. However, the lid could be manufactured in a variety of manners without departing from the spirit of the present invention.

This invention is usable with a wide variety of can sizes, including, but not limited to, #10, #8 (5.25 inch) and #6 (4.00 inch) metal cans. Products such as baby formula powders, iced tea powders, coffee, diet drink powders, bread crumbs, oatmeal, mashed potato mix, non-diary creamer powder, chocolate sauces, tomato puree sauce and hot chocolate powder are packaged in these standard sized cans. Additionally, most of these products includes a measuring scoop and plastic lid, but they are often disposed of once the container is finished. The present invention combines the principles of prior lids in a single, reusable product that is dishwasher safe.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

I claim:

1. A closure for a container, comprising:

a lid adapted to be releasably secured to the container to form an enclosure, the lid including a spout for pouring contents of the enclosure, an opening venting the contents of the enclosure and a push-pull vent movably retained within the opening for controllably venting the enclosure, the vent including a pair of arms selectively retaining the vent within the opening to permit the removal of the vent from said opening.

2. The closure according to claim 1, further including a cap covering the spout to form an airtight seal.

3. The closure according to claim 2, wherein the cap includes graduated lines for measuring.

4. The closure according to claim 1, wherein the lid includes a lip for creating an airtight seal with the container.

5. The closure according to claim 1, wherein said lid is plastic.

6. The closure according to claim 1, wherein said lid has a keyhole shape.

7. An enclosure, comprising:

a container;

a lid releasably secured to the container;

the lid including a spout for pouring contents of the enclosure, an opening venting the contents of the enclosure and a push-pull vent movably retained within the opening for controllably venting the enclosure, the vent including a pair of arms selectively retaining the vent within the opening to permit the removal of the vent from said opening.

8. The closure according to claim 7, further including a cap covering the spout to form an airtight seal.

9. The closure according to claim 7, wherein the lid includes a lip for creating an airtight seal with the container.

10. The closure according to claim 7, wherein said lid is plastic.

11. The closure according to claim 7, wherein said spout has a keyhole shape.

* * * * *